US007316084B2

(12) United States Patent
Allen

(10) Patent No.: US 7,316,084 B2
(45) Date of Patent: Jan. 8, 2008

(54) TRACK SLEDDING MACHINE

(75) Inventor: John Phillip Allen, Rangewood (AU)

(73) Assignee: Queensland Rail, Queensland (AU)

( * ) Notice: Subject to any disclaimer, the term of this patent is extended or adjusted under 35 U.S.C. 154(b) by 0 days.

(21) Appl. No.: 10/296,946

(22) PCT Filed: Jun. 14, 2001

(86) PCT No.: PCT/AU01/00701

§ 371 (c)(1),
(2), (4) Date: Apr. 1, 2003

(87) PCT Pub. No.: WO01/96662

PCT Pub. Date: Dec. 20, 2001

(65) Prior Publication Data

US 2003/0159316 A1 Aug. 28, 2003

(30) Foreign Application Priority Data

Jun. 14, 2000 (AU) ..... PQ8142

(51) Int. Cl.
*E02F 5/22* (2006.01)

(52) U.S. Cl. ..... 37/104; 37/105; 104/7.1; 104/7.3

(58) Field of Classification Search ..... 37/104–107; 14/7.3, 7.1
See application file for complete search history.

(56) References Cited

U.S. PATENT DOCUMENTS

| | | | | | |
|---|---|---|---|---|---|
| 748,503 | A | | 6/1903 | Holbrook | |
| 1,929,617 | A | * | 10/1933 | Walbridge | 104/7.3 |
| 2,624,130 | A | * | 1/1953 | Perier | 37/104 |
| 2,921,390 | A | | 1/1960 | Stein et al. | |
| 2,921,538 | A | * | 1/1960 | Croonenberghs | 104/8 |
| 2,974,429 | A | | 3/1961 | Stein | |
| 2,990,787 | A | * | 7/1961 | Christoff et al. | 104/7.3 |
| 2,993,451 | A | * | 7/1961 | Peppin | 104/7.3 |
| 3,020,853 | A | * | 2/1962 | Christoff | 104/7.3 |
| 3,055,309 | A | | 9/1962 | Moss | |
| 3,114,330 | A | * | 12/1963 | Christoff | 104/7.3 |
| 3,605,297 | A | * | 9/1971 | Kershaw | 37/105 |
| 3,811,382 | A | * | 5/1974 | Buchter et al. | 104/7.3 |
| 3,943,857 | A | * | 3/1976 | Theurer | 104/7.1 |
| 4,064,807 | A | * | 12/1977 | Theurer | 104/7.3 |
| 4,136,618 | A | * | 1/1979 | Boyer | 104/7.1 |
| 4,211,170 | A | * | 7/1980 | Theurer | 104/2 |
| 4,355,687 | A | * | 10/1982 | Theurer et al. | 171/16 |

(Continued)

FOREIGN PATENT DOCUMENTS

| | | |
|---|---|---|
| DE | 35 28 152 | 2/1986 |

(Continued)

OTHER PUBLICATIONS

Dictionary.LaborLawTalk.com at www.encyclopedia.laborlawtalk.com/Rail_tracks, May 11, 2005.*

*Primary Examiner*—Thomas A Beach
(74) *Attorney, Agent, or Firm*—Hoffman, Wasson & Gitler

(57) ABSTRACT

The invention relates to a machine for use in track sledding operations. Machine (1) comprises a wagon (2) having adjustably carried therebeneath a multibladed plough (3). A rail clamp assembly (4) is included for suspending the track above the plough during the sledding operations.

32 Claims, 11 Drawing Sheets

U.S. PATENT DOCUMENTS 5,046,270 A * 9/1991 Theurer et al. ..... 37/104

FOREIGN PATENT DOCUMENTS

| | | |
|---|---|---|
| DE | 35 28 171 | 2/1986 |
| EP | 0 499 018 | 9/1994 |
| EP | 0 712 961 | 6/1998 |
| GB | 1523523 | 9/1978 |

* cited by examiner

TRACK SLEDDING MACHINE

TECHNICAL FIELD

This invention relates to equipment for the maintenance of a railway. More particularly, the invention concerns machinery for removing ballast from a railway.

BACKGROUND ART

Railways generally consist of a track supported by a bed of crushed rock or gravel, this bed being referred to as "ballast" in the art. Most tracks comprise a pair of rails fixed to lateral members known as "sleepers" (or in some countries, "cross-ties"). Sleepers are formed from steel, timber or concrete.

There is a need as part of normal railway maintenance for the removal of track ballast. This is usually brought about by the ballast becoming fouled with soil or the like, or through there being excessive ballast present as a result of past maintenance. Ballast fouling prevents escape of water that can inundate the railway during heavy rain or flooding, while excessive ballast can lead to instability of the railway.

Ballast removal requires lifting of the track so that the ballast between and underneath the sleepers can be accessed. Normally, ballast removal is necessary over many kilometres of railway. The process must therefore be done mechanically as manual removal would be too inefficient due to the amount of labour that would be required to rapidly carry out the process to minimise track closure time.

Apparatus for removal of ballast is known in the art. One such apparatus is a sled consisting of a plough that is V-shaped in plan and is mounted into a frame over which the track is passed as the sled is drawn therebeneath. Skids are included in the frame to allow passage of the track over the sled which sled is pulled by steel cables connected between the sled frame and a locomotive. Ballast removal using this apparatus is referred to a "track sledding".

There are a number of disadvantages in using the sled described in the preceding paragraph for ballast removal. First, the cables by which the sled is pulled can break creating a potentially serious safety hazard. Second, track components, particularly sleepers, can be damaged as the track slides over the sled. Third, there is insufficient control over the sled during the sledding operation. Consequently, the remaining ballast bed may have a poor surface and the resulting track alignment poor necessitating substantial additional resurfacing.

Other apparatus for removal of ballast utilises endless chains to cut the ballast out from the track. Apparatus of this type leaves the track with good alignment and surface. However, the apparatus has a high capital cost of manufacture and is slow yet expensive to operate. Such apparatus is known in the art as ballast undercutting machinery.

Because of the disadvantages of ballast undercutting machinery, track sledding apparatus is the apparatus of choice for ballast removal. There is nevertheless a need for track sledding apparatus that overcomes the disadvantages of the apparatus described above. Specifically, there is a need for a track sledding machine that meets the following requirements:

1. the plough or any equivalent component is sufficiently controlled so that the surface of the remaining ballast or formation after the sledding operation is close to the original surface or to a desired surface with respect to top and cant without the need for substantial resurfacing thereby providing a railway that is suitable for the immediate passage of trains;
2. the track alignment can be sufficiently controlled during ballast removal to minimise resurfacing alignment corrections so that the railway is again suitable for the immediate passage of trains,
3. damage to track is eliminated or at least minimised; and
4. it can be moved at a speed that permits efficient removal of ballast without compromising operator safety.

SUMMARY OF THE INVENTION

The object of the invention is to provide a track sledding machine that meets the requirements set out above.

In a broad format, the invention provides a track sledding machine comprising:

a railway wagon having adjustably carried therebeneath a plough comprising at least on plough blade; and rail clamps for suspending said track above said plough to allow ploughing of ballast with movement of said wagon.

The principle of the track sledding machine described in the previous paragraph is that a plough is part of a machine of sufficient mass to provide for control of the plough during ballast removal. This results in a consistency of the surface of the remaining ballast bed or formation. Furthermore, the use of rail clamps to support the track clear of the plough as the plough passes thereunder reduces to essentially nil the instances of damage to track components. As the machine in its preferred embodiment is designed to be direct coupled to a standard locomotive, the major safety risk of at least the sledding apparatus described above is eliminated.

To effect efficient operation of the plough in giving a ballast bed or formation surface that has close to the desired surface, the machine typically has a minimum weight of 60 or 70 tonnes depending on allowable axle loads for the track on which it is to operate. This ensures that the plough is held at a constant level by the mass of the machine and is not displaced when a more firmly packed region of ballast or an obstacle within the ballast is encountered. The use of rail clamps for elevating the track further enhances the stability of the machine in operation—up to 30 tonne lift can be applied to the track in some circumstances.

The wagon, or machine main frame, of the track sledding machine of the invention can be of any configuration. Advantageously, the wagon comprises a horizontal frame to which bogies including brakes are mounted at each end thereof and has vertically extending framework to which machine components and equipment of operating components can be attached.

The multibladed plough typically comprises a plurality of blades that are V-shaped in plan. The machine proceeds with the points of vees foremost during ploughing so that ballast is largely displaced to the sides of the track for subsequent removal if necessary. In instances where displacement of ballast to only one side of the track is desired, the plough can be configured to include a plurality of blades that are straight in plan but are angled across the machine. Displacement is then to the side of the machine at the trailing ends of the blades. Ploughs can also comprise a combination of V-shaped and straight blades to achieve the same end result of displacement of ballast to one side of the railway. Ploughs can be configured so that the angle of blades can be varied. The angle of the "V" typically ranges between 60 to 120°. Straight blades can advantageously be varied through a range of 10 to 60° to the plough centre-line.

Ploughs can have from one to twenty blades but typically have from four to eight blades. With a plough comprising V-shaped in plan blades, a minimum of four blades is preferred although six blades are also efficacious with straight blades.

The plough blades typically have a width of 100 to 300 mm. This allows cutting to a minimum of about 100 mm with there being sufficient headroom between the chassis of the wagon and the elevated plough, and for the track to be lifted within rail stress considerations.

Machines according to the invention can include blades for pre-cutting ballast. These blades are mounted, typically as pairs, ahead of the plough with the blades comprising a pair on opposite sides of the machine. In a machine based on a wagon of 20 m, there is sufficient space ahead of a centrally positioned plough for from one to six pre-cutter blades or blade pairs although machines can have from one to ten or more pre-cutter blades or blade pairs. The pre-cutter blades serve to remove ballast from the edges of the ballast bed to under the ends of the sleepers. Where more than one pair of pre-cutter blades is fitted, the blades are configured so that a following blade undercuts a sleeper more than the preceding blade. In such a configuration, the first pre-cutter blade removes the shoulder ballast close to the final desired depth of cut and an initial portion of ballast from under and between the sleeper ends. Lifting of the track above the pre-cutter blades is not required for ballast removal with the pre-cutter blades as the track is still supported by the ballast that is as yet uncut. The pre-cutter blades thus serve to reduce the amount of ballast that has to be removed by the plough thereby allowing a greater depth of cut with the plough.

In circumstances where the upper layer of ballast is unfouled, the plough can be set to return some of the upper layer to beneath the track by flow over the upper edges of the plough blades. That is, all ballast is not necessarily displaced to the side or sides of the track.

In some instances it is desirable to selectively remove ballast from the upper, lower or middle section of the ballast bed. To achieve this end, the space between the blades can be covered with sheet material, typically level with the top of the blades, so that ballast cannot enter the plough from above. Under this condition, the upper ballast will slide over the top of the plough and be returned to the track whilst the ballast stratum in front of the plough or presented to each individual blade is removed when the plough blades are drawn therethrough. Using such a covered, or "sheeted in", plough, the lower stratum of the ballast bed, for example, can be selectively removed. When pre-cutter blades are included in a machine, any spaces therebetween are also advantageously covered at otherwise they may remove the stratum of ballast that is above the plough blades.

As an alternative to the full covering of the plough with sheet material as described in the previous paragraph, the covering can be a mesh or grating which has apertures of a sufficient size to allow unwanted smaller rock and fines to enter the plough and be discharged whilst the larger reusable ballast particles are passed over the plough and returned to the track. In other embodiments of the invention, the plough can have spaces between blades alternately covered with sheeting and grating material.

In yet another embodiment, the leading blade of a covered plough can be replaced with a ramp which can lift essentially all of the ballast over the plough.

The plough of machines according to the invention can have associated therewith a vibrator to enhance ballast flow over the plough and separation of ballast.

The plough comprises a frame or at least two interconnected rails to which the blades are fixed. Blades typically have a concave leading face and are fabricated from hardened steel. Ploughs can also include longitudinally-extending skids on the upper edges of blades or on the plough frame to minimise damage to track in the event of a rail clamp failure or in the event of a sleeper falling from the track.

The adjustable carriage of the plough beneath the wagon is typically via arms of variable length fixed to at least the rear corners of the plough with the upper ends of these arms fixed to the wagon framework. The machine also can include at least one drawbar extending from the wagon to the leading edge of the plough. The plough is preferably attached to the arms and any drawbar by shear pins designed to allow disengaging of the plough in the event of severe overload such as encountering an obstruction in the ballast. Furthermore, the plough can include an offset ripper or scarifier tyne forward of the first plough blade to feed any buried obstruction, such as a sleeper, to a side of the centreline of the machine and out of the way of the plough during ballast removal.

As the arms connected to at least the rear corners of the plough are of variable lengths the longitudinal and lateral tilt of the plough can be adjusted. Longitudinal tilting of the plough allows the depth of cut to be varied. Typically, the depth of cut is varied from of the order of 100 mm below the bottom of the sleepers (when in situ on the ballast) to up to about 400 mm below the bottom of the sleepers. This allows for merely the reduction of the amount of ballast in the railway or essentially the entire removal of the ballast. The latter would apply in the instance of fouled ballast and removal would be followed by replacement with fresh ballast. When longitudinally tilted, the highest blade is usually at the leading edge of the plough.

Lateral tilting of the plough allows the cant of the remaining ballast bed or formation to be adjusted. Such tilting of the plough can be by up to any angle with respect to the horizontal allowed by normal machine and track geometry. To aid cant control, the suspension of the wagon lead bogie is locked out. This enables the machine frame (including plough and rail clamps) to follow closely the cant at the lead bogie thus minimising control inputs when curves and the like are encountered.

It will be appreciated by those of skill in the art that the maximum depth of cut of the plough is limited the plough capacity and by allowable rail stress during the ballast removal operation and the machine wheelbase. The maximum of 400 mm given above is achievable with a wagon having a 17 m wheelbase based on rail stress considerations. However, a greater maximum cut is achievable using a wagon with a wheelbase of greater than 17 m.

The rail clamps used for suspending the track above the plough can be any rail clamp known to those of skill in the art. Typically, one pair of clamps are employed; although two pairs of clamps are advantageous on longer wheelbases, one pair leading the plough and one pair trailing the plough with the clamps of a pair acting on opposite rails. Clamps advantageously include a mechanism that allows overriding of obstacles such as fishplates and weld flashing at rail junctions. A preferred rail clamp is the roller rail clamp described in the applicant's co-pending application entitled "Roller Rail Clamp".

Continuously variable machine components, such as the variable length arms associated with the plough, can be powered in any suitable way. A preferred power is hydraulic power and to facilitate this a hydraulic pump can be included in the machine with an appropriate hydraulic circuit. The machine typically also includes controls at an operator station for adjusting machine components.

For maximum flexibility of the machine, the wagon is advantageously configured so that it can be operated in either direction. To do this, however, duplicate plough mountings must be provided so that the plough can be reversed for operation in the opposite direction to that in which the machine was previously operated.

Prior to a ballast removal operation, the plough is disconnected from the machine and installed under the track at the beginning of the section of railway where ballast is to be removed. Installation of the plough of course requires lifting of the track with a crane or any other suitable equipment. It will be appreciated that some excavation of ballast may be required to position the plough under the track. The machine is then brought along the track over the plough and the plough and rail clamps connected thereto. The ballast removal operation can then be initiated. As an alternative to a crane or other equipment, the rail clamps of the sledding machine can be used for lifting the track for plough installation. This eliminates a need for additional equipment.

Following ballast removal, the plough is removed by a reversal of the installation procedure. If it is necessary to free the track for normal railway traffic prior to completion of ballast removal from the subject section of railway, the plough can be disconnected from the wagon and left in track for passage of such traffic thereover with appropriate reduction of speed.

There can be many other variations in the track sledding machine of the invention. Machines can have more than one plough per wagon. That is, the machine components set out above can be duplicated on a wagon to provide tandem ploughs. Multiple ploughs can in fact be installed beneath a single wagon. Alternatively, multiple machines comprising a single plough per wagon can be used in a series operation. The multiple ploughs associated with one wagon or with a series of wagons do not necessarily have to be identical. The multiple ploughs can be any combination of open ploughs and the covered ploughs described above.

To allow fitting of additional ploughs to a wagon, the wagon can have an extendible main frame and/or a variable wheelbase.

As indicated above, in a preferred embodiment, the machine is designed to be coupled to a standard locomotive by which it can be pushed or pulled. However, the wagon comprising the machine can be self-propelled with an appropriate engine and drive train fitted thereto.

A sledding operation using a machine according to the invention can be in combination with activities such as ballast pick-up, cleaning and return. Other applications of the machine will be readily recognisable to one of skill in the art of track maintenance.

Having broadly described the invention, a machine will now be exemplified with reference to the accompanying drawings which will now be briefly described.

BEST MODE AND OTHER MODES OF CARRYING OUT THE INVENTION

Figure 1:
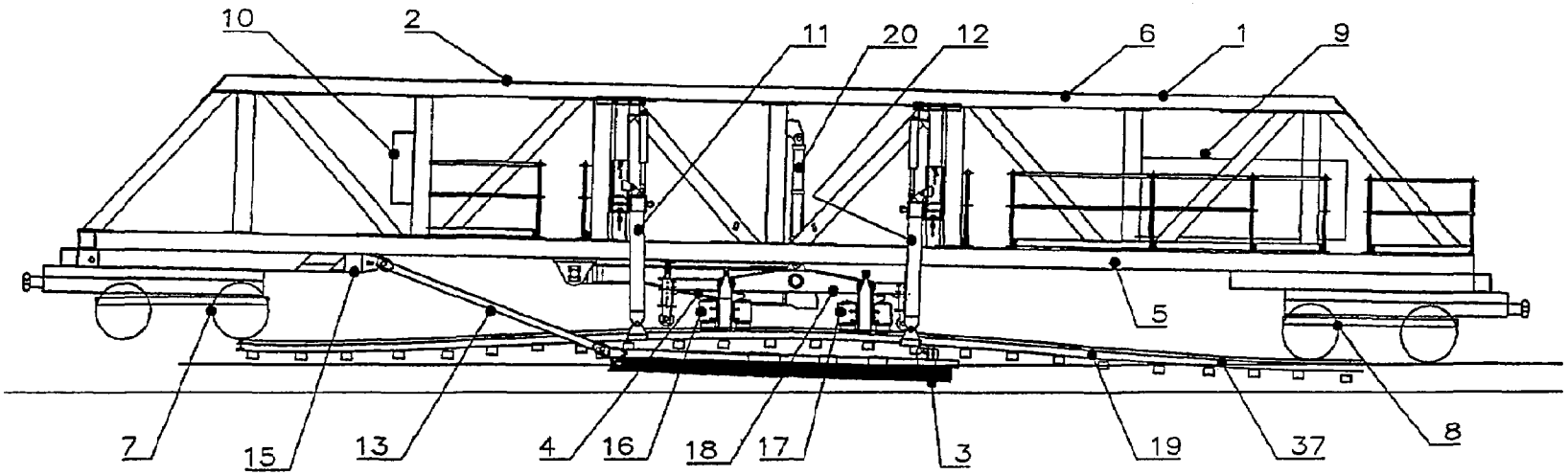
FIG. 1 is a partially schematic elevational view of a track sledding machine according to the invention.
Figure 2:
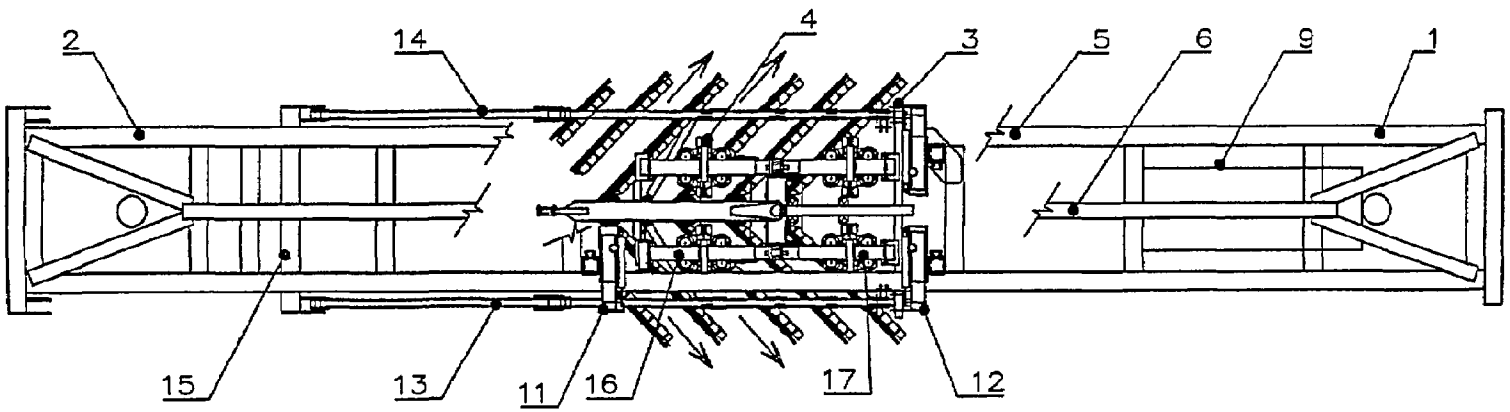
FIG. 2 is a plan view of the machine shown in FIG. 1.

In FIGS. 1 and 2 there is shown track sledding machine 1 comprising a wagon 2, plough assembly 3 and a rail clamp assembly 4. The figures are partially schematic and components have been omitted that are not necessary to an understanding of how the machine functions.

Wagon 2 includes a horizontal frame 5 and a truss frame 6 thereon. It has a length of 20 m. The wagon rolls on bogies 7 and 8, and has standard buffers and couplings at each end thereof. The wagon further includes an engine module 9 for powering a hydraulic system (not shown in the figures) used for operating machine components, and a control console 10.

Plough assembly 3 is held below wagon 2 by carrier arms, one at each corner of the assembly. The arms proximal the viewer in FIG. 1 are items 11 and 12. Each carrier arm comprises an hydraulic ram and a vernier pin adjustable slide. Alternatively, a carrier arm can comprise an hydraulic ram alone. Machine 1 also includes two drawbars, 13 and 14, extending from ends of a lateral member 15 fixed to horizontal frame 5 of wagon 2 to the plough assembly (3). The plough assembly will be described in greater detail below.

Rail clamp assembly 4 comprises a pair of clamps for each rail, one pair being indicated as items 16 and 17, which pairs of clamps are pivotally linked to wagon frame 5 by an arm and sub-assembly 18 (see FIG. 1). A pair of hydraulic rams effects the lifting of track 19, one for each rail, coupled between wagon frame 6 and sub-assembly 18. The ram closest the viewer in FIG. 1 is item 20.

Figure 3:
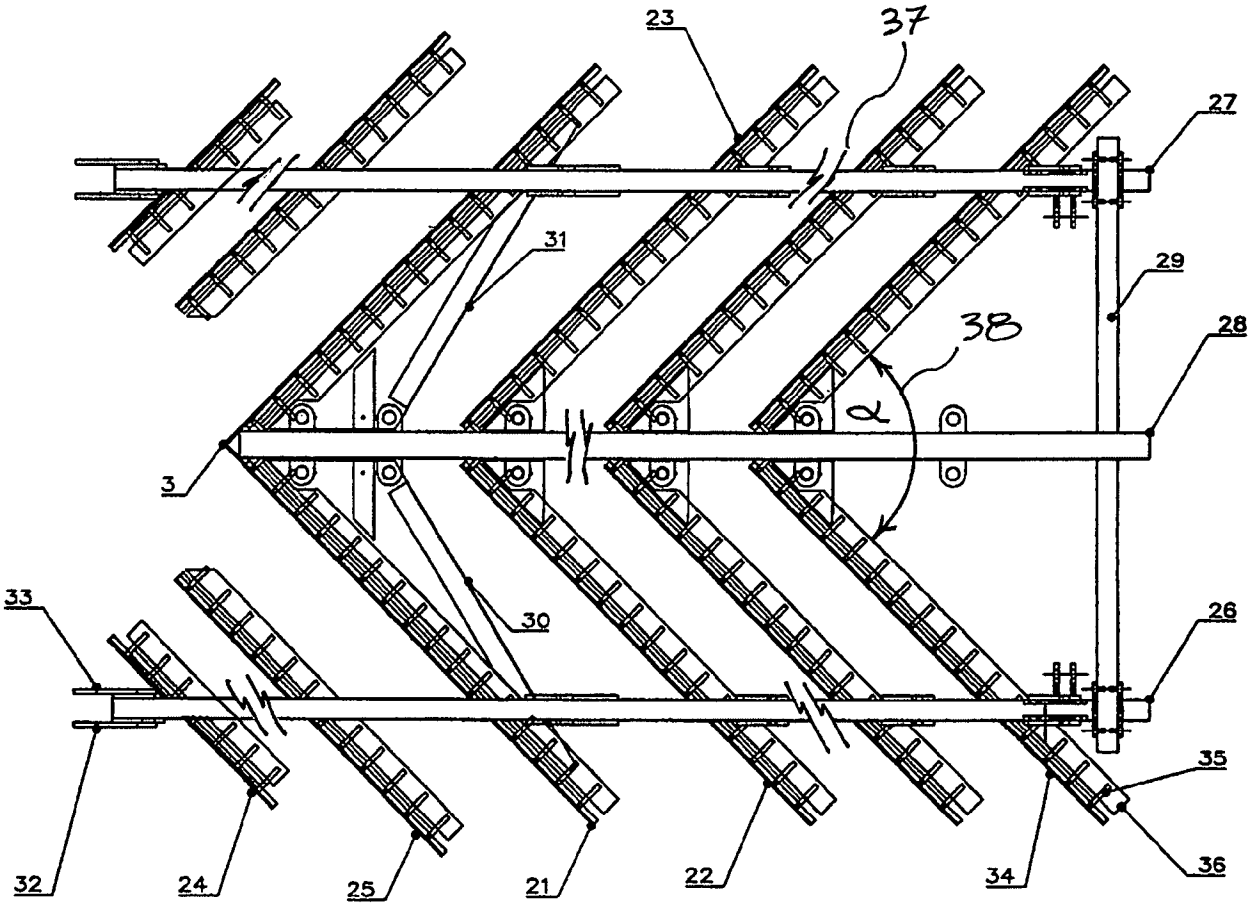
FIG. 3 is a view in plan of the plough of the FIGS. 1 and 2 machine.
Figure 4:
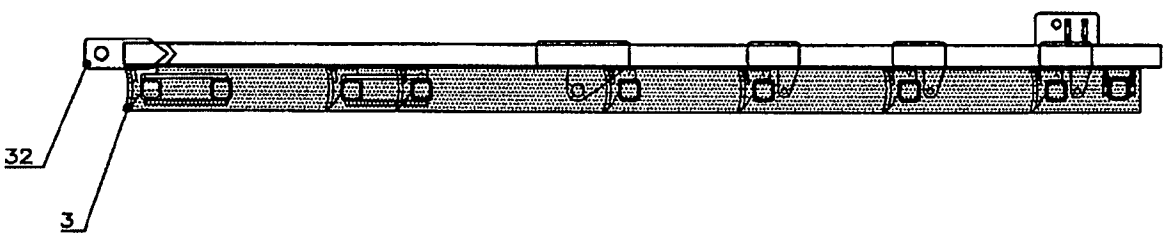
FIG. 4 is an elevational view of the plough shown in FIG. 3.

The plough assembly 3 is shown in greater detail in FIGS. 3 and 4. As can be seen from FIG. 3, plough assembly 3 comprises a number of blades, one of which is indicated at 21. The blades can be seen to be V-shaped in plan and consist of two sub-blades 22 and 23. The assembly includes pre-blades. The pre-blades on one side of the plough are items 24 and 25.

Plough assembly 3 is held together by rails 26 and 27, and a centre spine 28. A transverse brace 29 links the rails and centre spine. Leading blade 21 includes braces 30 and 31 extending from near the extremities of the sub-blades to centre spine 28. Plates are provided with holes therethrough for attachment of the drawbars and carrier arms. For example, plates 32 and 33 at leading end of rail 26 provide a point of attachment for drawbar 13 (see FIGS. 1 and 2). Plough assembly 3 is attached to the drawbars and carrier arms using shear pins.

As indicated above in Summary of the Invention, plough assembly 3 can comprise from one to twenty blades. The assembly can further include from one to four pairs of pre-cutter blades. The assembly shown in FIGS. 3 and 4 has two pairs of pre-cutter blades and four V-shaped plough blades, which numbers are preferred. Additional pre-cutter and plough blades can be added to the assembly by merely increasing the lengths of rails 26 and 27, and centre spine 28. This is illustrated in FIG. 3 by the break lines in these members—item 37 for example.

As further indicated above, the angle between the arms of a V-shaped plough blade can be between 60° and 120°. This is shown by the curved arrow 38 of FIG. 3 which subtends an angle "α".

Figure 5:
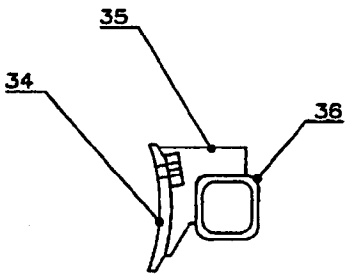
FIG. 5 is an end elevation of a plough blade.

FIG. 5 is an end view of a blade which is in itself an assembly comprising a curved blade 34 per se fixed via a plurality of webs, one of which is item 35, to an elongate box section member 36. Web 35 and box section member 36 are also indicated in FIG. 3.

Other features of the track sledding machine referred to in the Summary of the Invention above are illustrated in FIGS. 6 to 14.

Figure 6A:
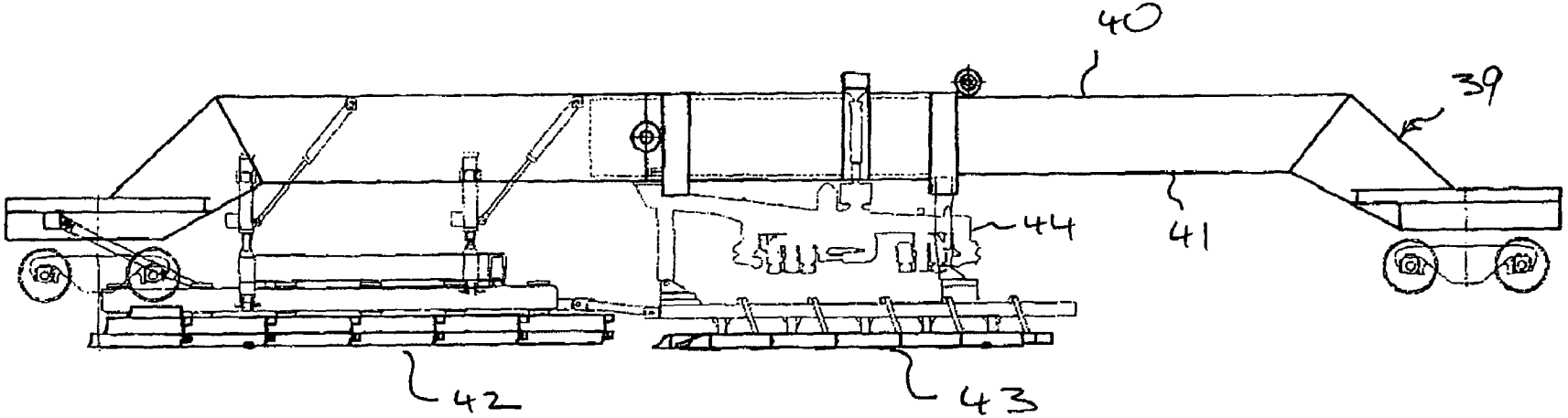
FIG. 6*a* shows the wagon of the machine in an extended form while in FIG. 6*b* the wagon is retracted.
Figure 6B:
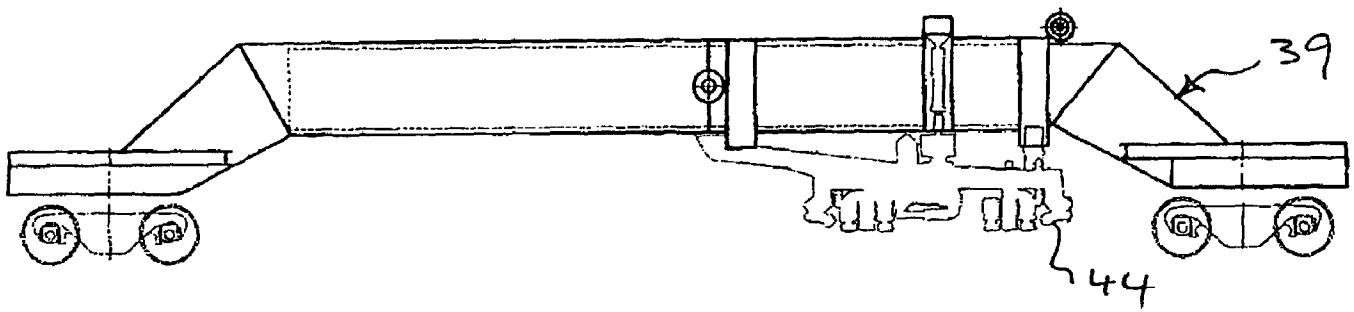
FIG. 6 is a semi-schematic side view of a track sledding machine according to a further embodiment of the invention.

The variable length of the wagon which carries the plough can be appreciated from FIG. 6. In FIG. 6*a*, an extended wagon 39 is illustrated while wagon 39 in a retracted state is shown in FIG. 6*b*. The variation in length is possible through frame members such as 40 and 41 being telescopic.

FIG. 6*a* further illustrates a track sledding machine comprising two ploughs 42 and 43. Rail clamp apparatus 44 is shown in phantom in both FIGS. 6*a* and 6*b*.

Figure 7:
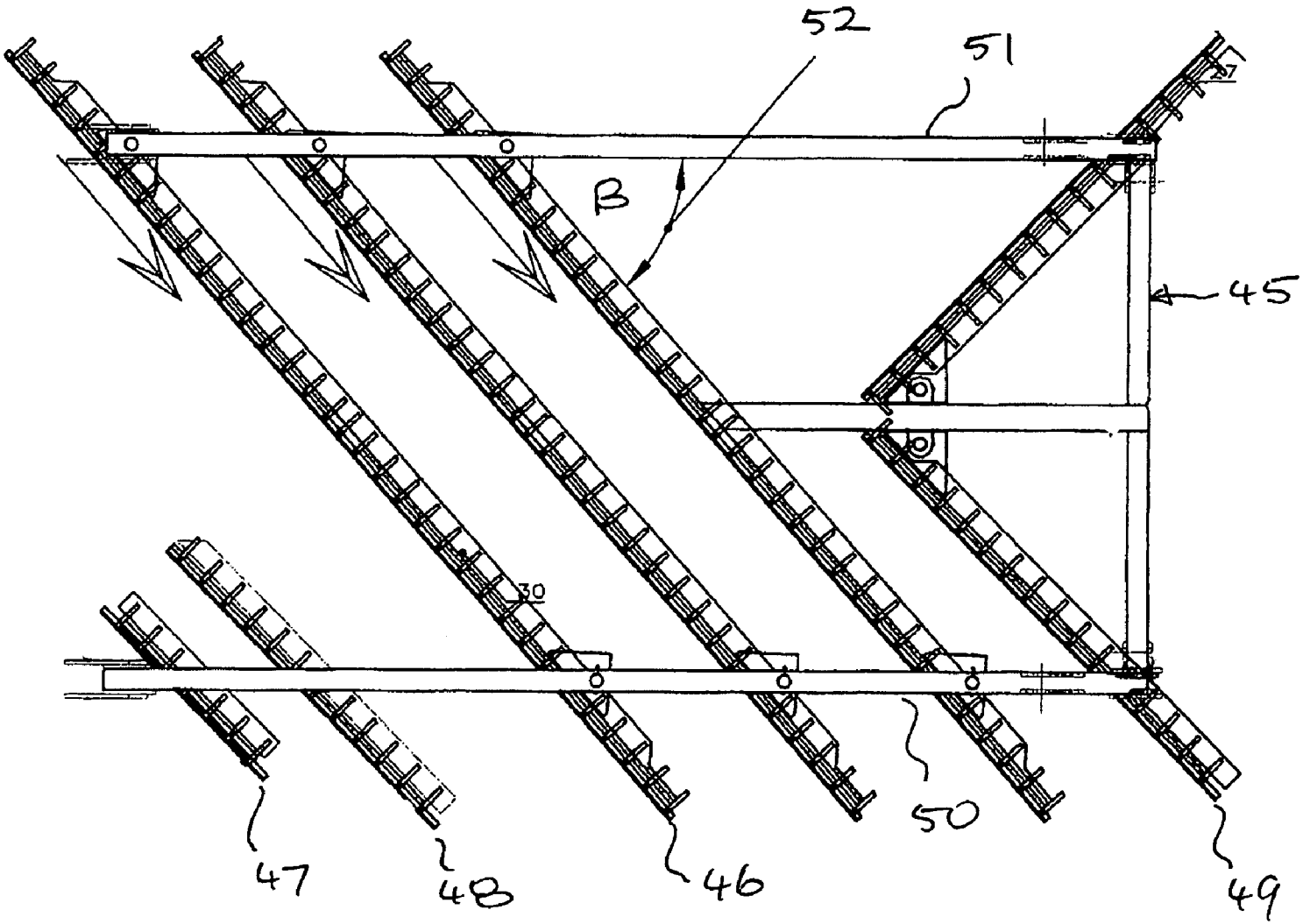
FIG. 7 is a plan view of an alternative plough of the track sledding machine.

A plough comprising straight blades is depicted in FIG. 7. Plough assembly 45 comprises three straight blades one of which is item 46. Plough 45 also has two pre-cutter blades, 47 and 48, and a single V-shaped blade, 49. Like plough assembly 3 of FIGS. 3 and 4, plough 45 has rails 50 and 51 to which the blades are mounted.

The angle of the straight blades of plough assembly 45 relative to the centre line of the plough—and hence side arms 50 and 51—can be varied. This is indicated by the curved arrow 52 which subtends an angle "." which can be 10° to 60°.

Figure 8A:
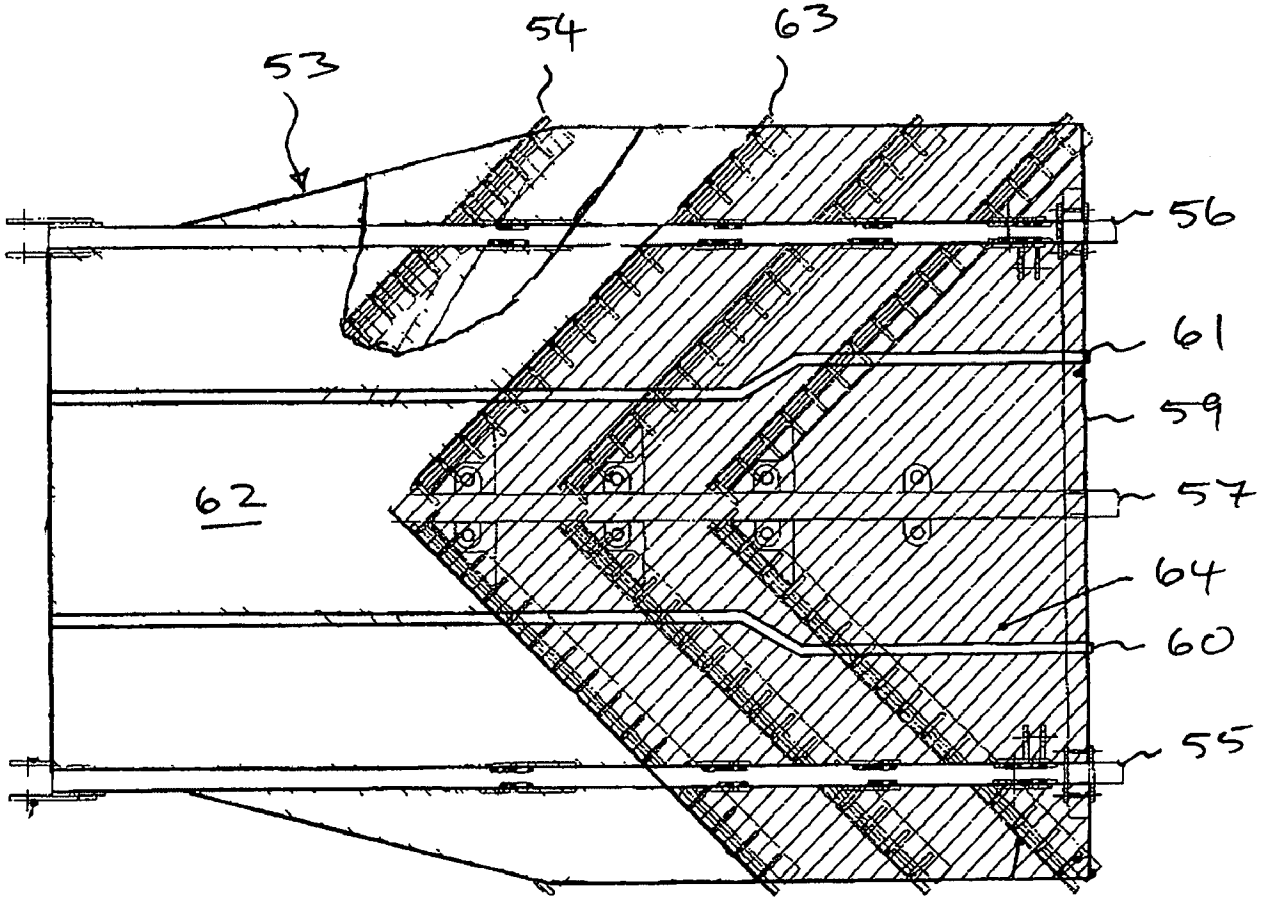
FIGS. 8*a* and 8*b* are plan and side views respectively of a plough which includes skids and has a partially covered top.
Figure 8B:
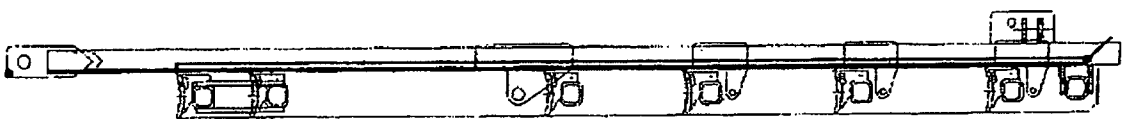

Turning now to FIGS. 8*a* and 8*b*, there is shown plough assembly 53 which has four V-shaped blades, the first of which is item 54. In the same manner as plough 3 of FIGS. 3 and 4, the blades of plough 53 are mounted to rails 55 and 56, and a centre spine 57. These members are linked by a transverse brace 59.

Plough 53 of FIGS. 8*a* and 8*b* further includes longitudinally extending skids 60 and 61. As indicated above in Summary of the Invention, the skids are to prevent damage to track in the event of rail clamp failure. Further features of plough 53 are a sheet metal covering 62 at the leading end of the plough which extends through to second blade 63. Covering 62 is partially broken-away to reveal portion of blade 54 beneath the cover. The remainder of the plough is covered by a grating 64. These coverings allow selective return of ballast to the track bed as discussed above.

Figure 9A:
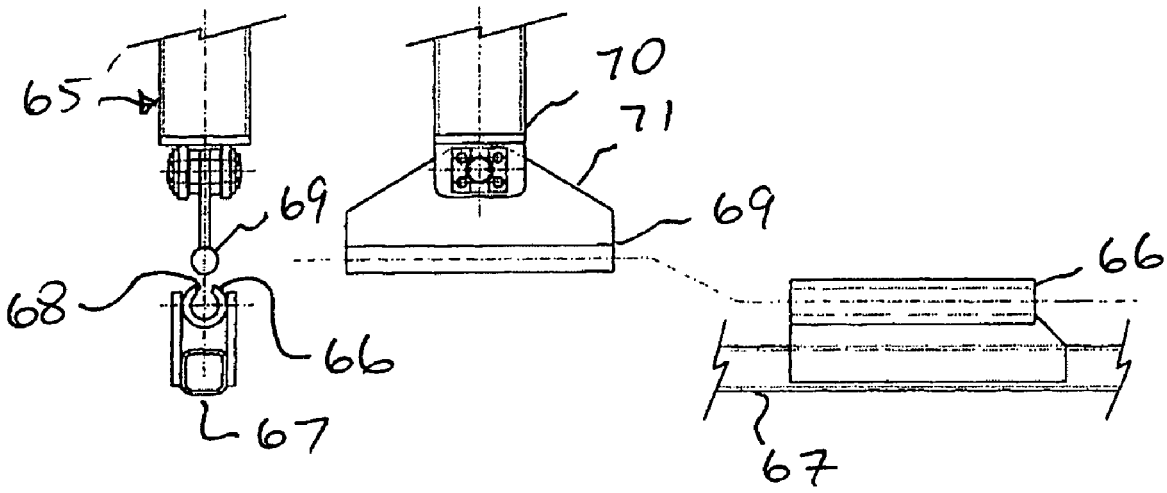
FIGS. 9*a* and 9*b* are each end and side views of horizontal slides by which plough arms can be connected to the plough.
Figure 9B:
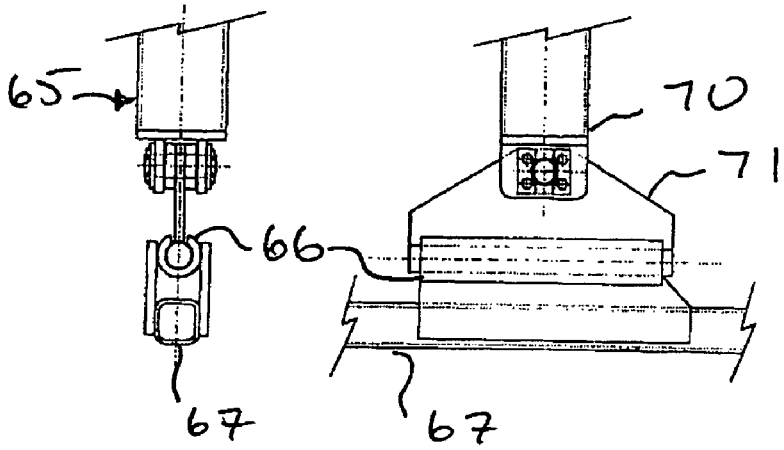

FIGS. 9*a* and 9*b* each comprise end and side views of a longitudinal slide arrangement 65 by way of which the ends of arms 11 and 12 of FIGS. 1 and 2 can be attached to a plough assembly of the track sledding machine. FIG. 9*a* shows the components of the slide disengaged for clarity while the components are shown engaged in FIG. 9*b*.

Horizontal slide 65 comprises a tube 66 mounted to a rail of the plough, a portion of which rail is item 67. Tube 66 has a slot 68 along its uppermost surface which slot can be seen in the end view of FIG. 9*a*. Tube 66 receives a cylindrical member 69 which is pivotally connected to an end 70 of the arm via a planar member 71. Planar member 71 extends up through slot 68 of tube 66 in which it is a clearance fit.

Figure 10A:
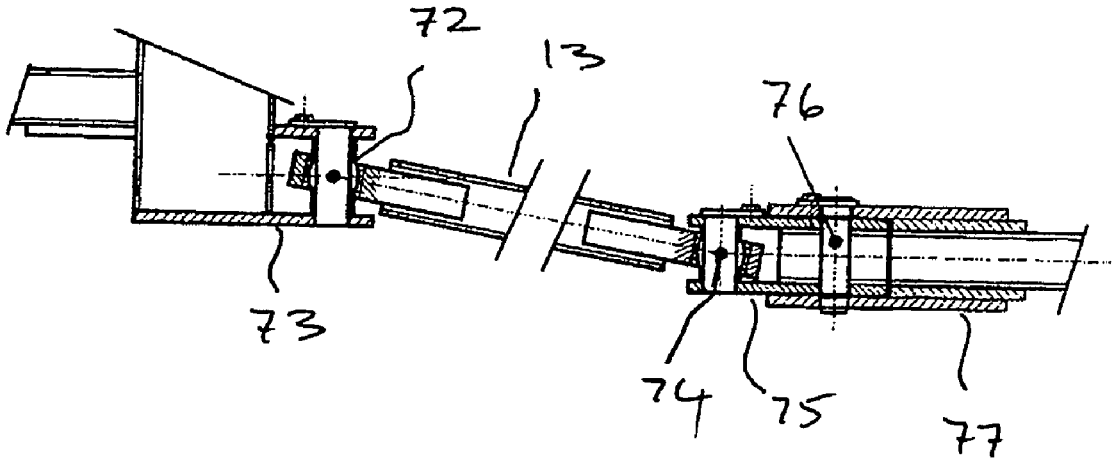
FIGS. 10*a* and 10*b* are plan and side views respectively of a draw bar by which the plough is connected to the wagon of the track sledding machine.
Figure 10B:
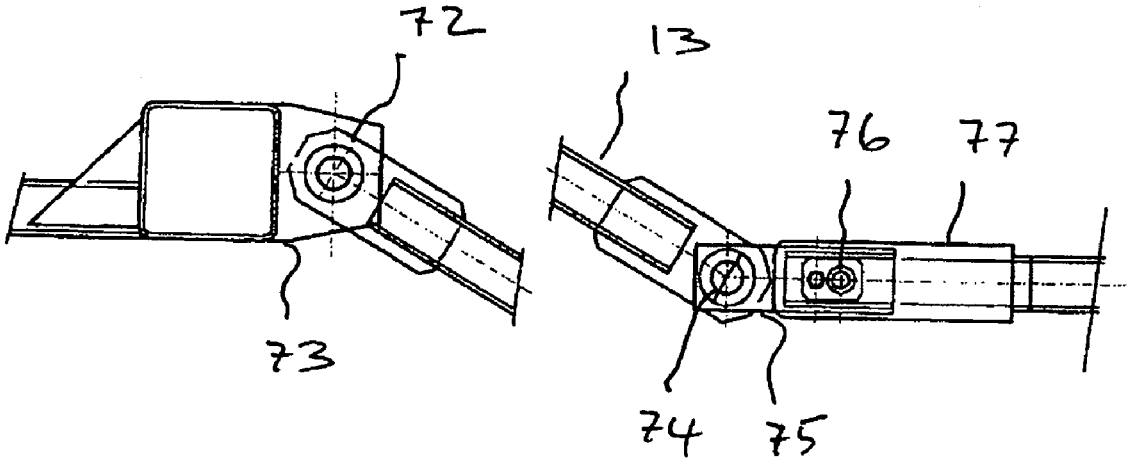

FIG. 9 provides detail of the linkage of drawbar 13 between wagon 2 and plough assembly 3 of FIG. 1. FIG. 10*a* is a plan view while FIG. 10*b* is a side view. Drawbar 13 is connected at one end via a universal joint 72 to a member 73 on wagon 2. At its other end, drawbar 3 is connected via a universal joint 74 to a member 75 which is in turn connected via a shear pin 76 to the leading end 77 of a rail comprising part of plough assembly 3.

Figure 11A:
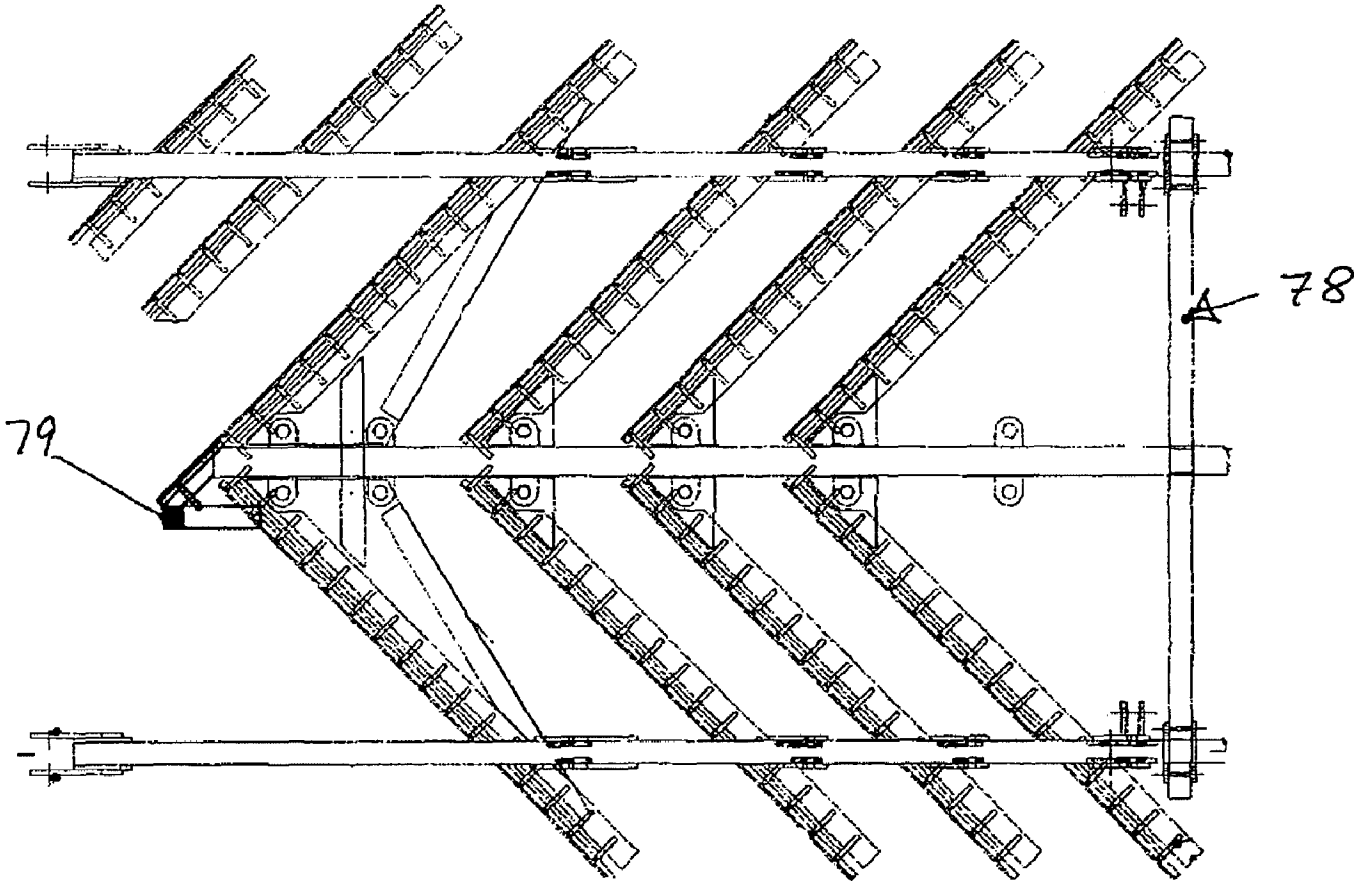
FIGS. 11*a* and 11*b* are plan and side views respectively of a plough which includes an offset ripper tyne.
Figure 11B:
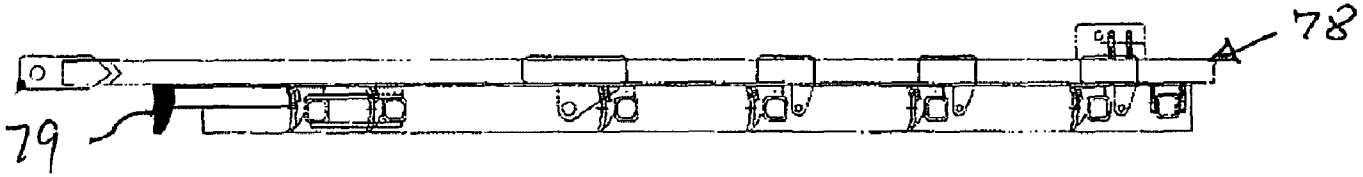

FIGS. 11*a* and 11*b* show a plough assembly 78 which has an offset ripper tyne 79 ahead of the leading plough blade 80. Plough 78 is otherwise essentially the same as plough assembly 3 of FIGS. 3 and 4 save that pre-cutter blades are omitted from the side of the plough on which ripper tyne 79 is located.

Figure 12A:
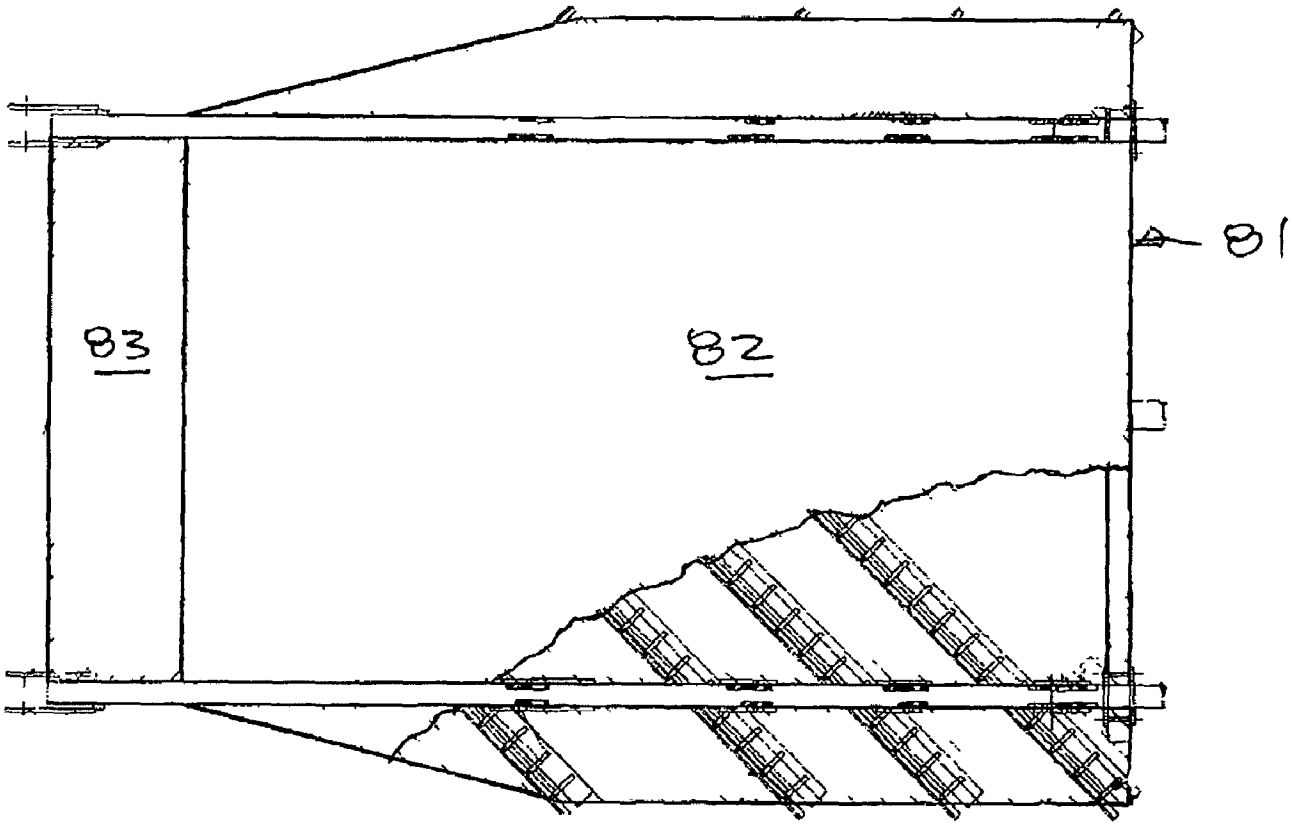
FIGS. 12*a* and 12*b* are plan and side views respectively of a plough which includes a ramp and has a covered top. The cover is partially broken away to reveal components beneath the cover.
Figure 12B:
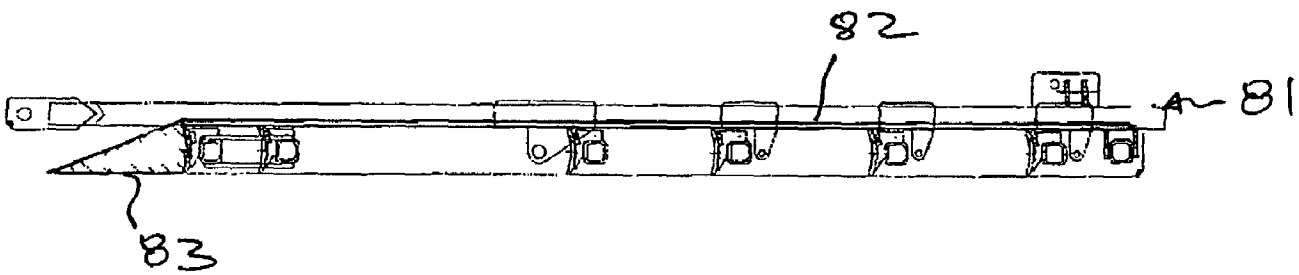

FIGS. 12*a* and 12*b* depict a covered plough assembly with a ramp. Plough assembly 81 is essentially the same as plough assembly 3 of FIGS. 4 and 5 save that it does not have pre-cutter blades. The blade components of plough assembly 81 common to plough assembly 3 can be appreciated from the cutaway portion of cover 82 over the plough. Ramp 83 can be seen at the front of the plough.

Figure 13A:
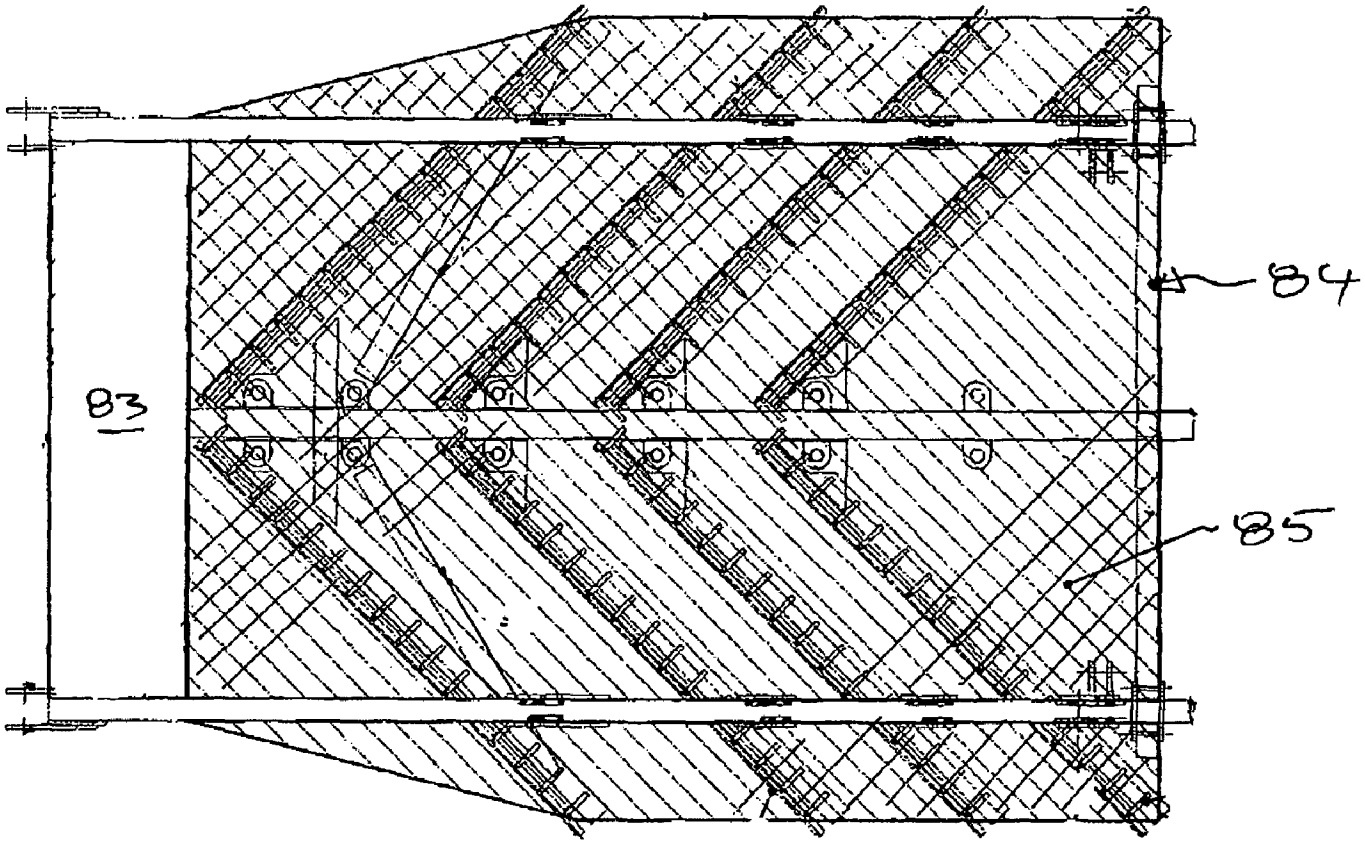
FIGS. 13*a* and 13*b* are plan and side views respectively of the plough shown in FIGS. 12*a* and 12*b* but with a mesh on the top thereof rather than a cover.
Figure 13B:
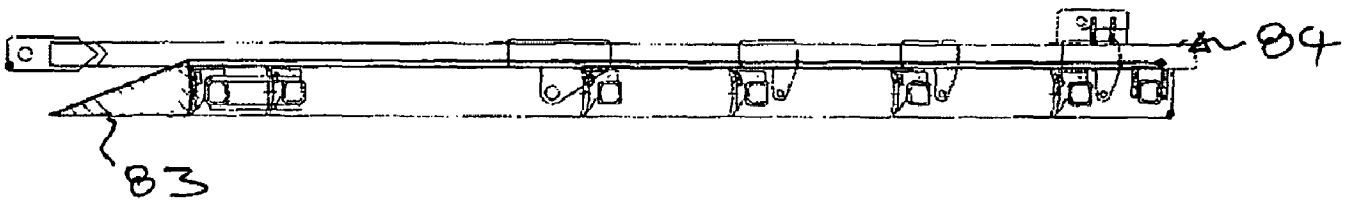

In FIGS. 13*a* and 13*b*, there is shown a plough assembly 84 like that of FIGS. 12*a* and 12*b* save that the covering over the plough is a mesh 85.

Figure 14A:
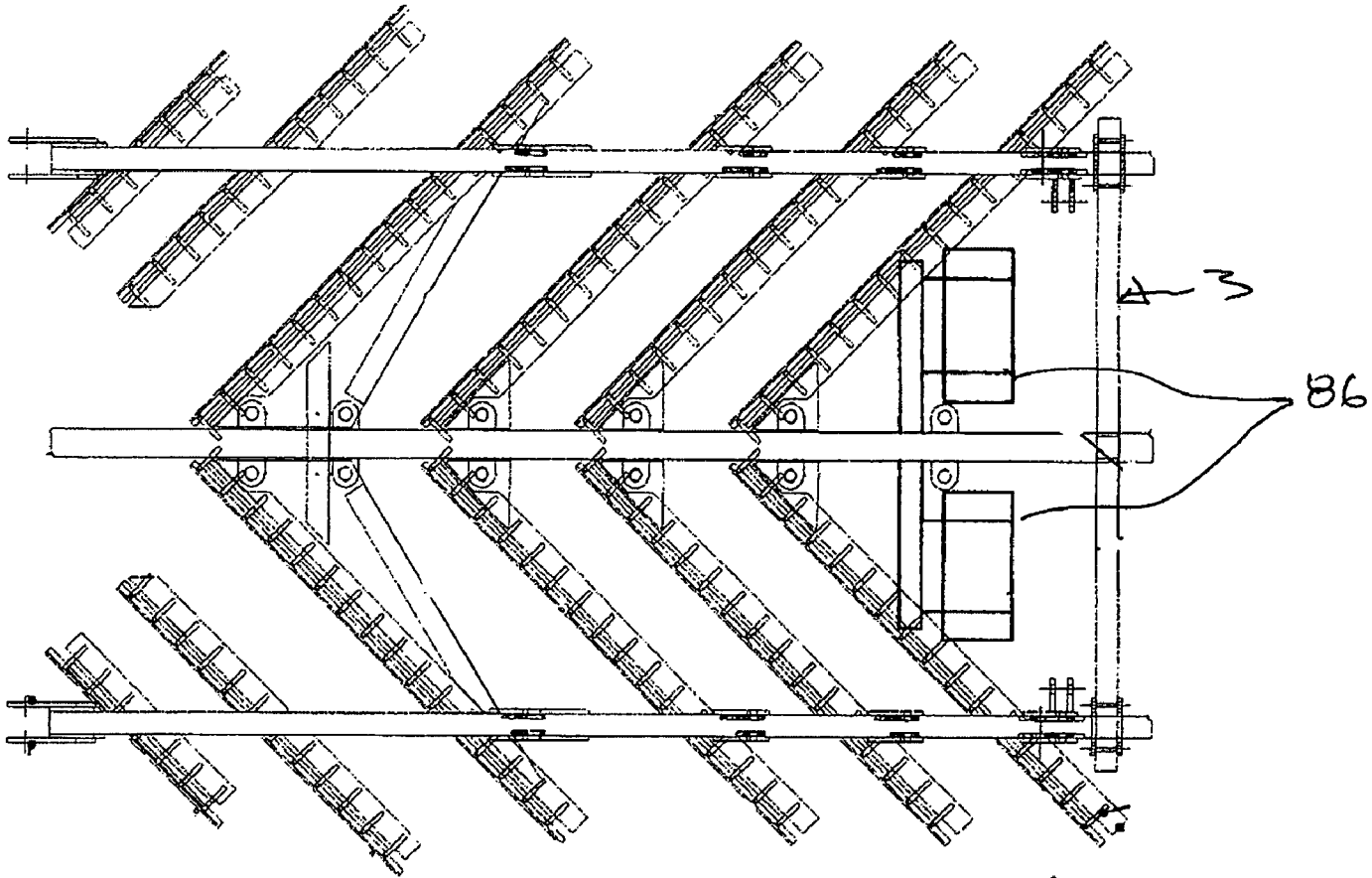
FIGS. 14*a* and 14*b* are plan and side views respectively of the plough shown in FIGS. 3 and 4 with a vibrator added In the figures, the same item number is used for a feature included in more than one drawing. A particular drawing is not necessarily to the same scale as other drawings.
Figure 14B:
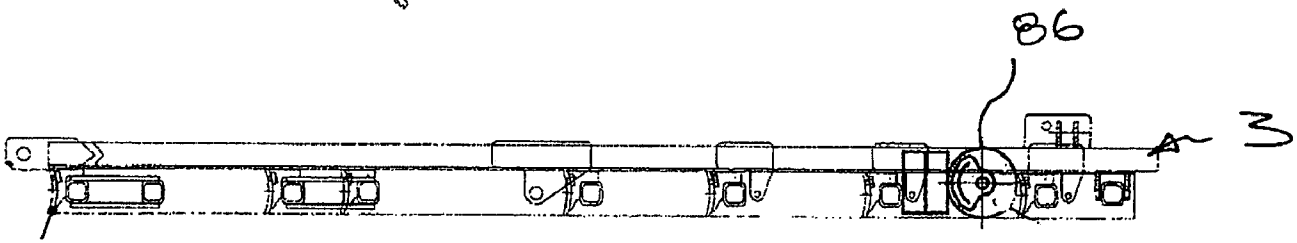

FIGS. 14*a* and 14*b* depict plough assembly 3 of FIGS. 3 and 4 but further including a vibrator 86.

The track sledding machine exemplified above is suited for operation on track having rail sizes in the range of 41 to 60 kg/m. The use of the machine on such track for the reduction of ballast is illustrated in FIG. 1. After installation of plough assembly 3 Under track 19, wagon 2 is positioned thereover and the drawbars (13 and 14) and carrier arms (11 and 12) connected to the plough. The tilt of the plough is adjusted as required for the desired depth and cant—it can be seen in the figure that the trailing end of the plough (movement of machine 1 is to the left as viewed in FIG. 1) is lower than the leading edge. It can also be appreciated from FIG. 1 that rail clamp assembly 4 holds the track between the wagon bogies clear of the plough.

Movement of the machine results in the plough displacing ballast to the sides of plough assembly 3—see arrows in the plan view of FIG. 2. As a consequence, the track is lowered due to the reduction of the amount of ballast: compare the level of the track to the left of plough assembly 3 in FIG. 1 to the level of the track to the right of the plough. If desired, the plough can be set so as to pass the top layer of clean ballast over the tops of the plough blades to be deposited beyond the plough under the trailing section 37 of track 19. This serves to economise on the ballast required for reinstatement of the track.

Machine 1, which has a total operational weight of 60 to 70 tonne, is towed by a 90 or 120 tonne locomotive. Tandem locomotives can also be used. With such locomotives, the sledding operation can be performed at 5 to 20 km per hour depending on the condition of the track, with 5 to 10 km/hr being a typical speed. It will be appreciated from FIG. 1 that the length of the wagon allows suspension of the track above the plough yet the weight of the machine as a whole gives full control over the plough so that ballast is efficiently removed. Furthermore, the machine geometry allows track to be lowered to within about 30 mm of the original track centreline. Additional, the rail clamp assembly can be manually or automatically controlled to effect track offset with respect to an initial datum.

It will be appreciated that many changes can be made to the track sledding machine and use thereof as exemplified above without departing from the broad ambit and scope of the invention The term "comprise", or variants thereof such as "comprising" or "comprised", is used herein to denote the inclusion of a stated integer or integers, unless is the context of usage an exclusive interpretation of the term is required.

The invention claimed is:

1. A track sledding machine comprising:

a railway wagon having adjustably carried therebeneath a plough comprising at least one plough blade having a length greater than the width of the track ballast bed; and rail clamps for suspending said track above said plough to allow continuous ploughing of ballast with movement of said wagon whereby said plough displaces said ballast beyond at least one side of the ballast bed, wherein said rail clamps comprise a subassembly pivotally linked to said wagon, the subassembly comprising a pair of longitudinally extending arms with clamps at each end of an arm.

2. The machine according to claim 1, wherein said wagon is adapted for connection to a locomotive and comprises a horizontal frame with spaced apart bogies having a vertical frame thereon for mounting of machine components.

3. The machine according to claim 1, wherein said wagon is of variable length.

4. The machine according to claim 1, wherein said plough comprises a plurality of blades that are V-shaped in plan with the points of vees foremost in use.

5. The machine according to claim 4, wherein the angle of the vee of said blades ranges from 60 to 120°.

6. The machine according to claim 1, wherein said plough comprises a plurality of blades that are straight in plan but angled relative to the centre-line of said wagon.

7. The machine according to claim 5, wherein the angle of said blades can be varied through a range of 10 to 60° from the plough centre-line.

8. The machine according to claim 1, wherein said plough comprises from one to twenty blades.

9. The machine according to claim 8, wherein said plough comprises four blades.

10. The machine according to claim 1, wherein said machine includes at least one blade ahead of said plough for pre-cutting ballast.

11. The machine according to claim 10, wherein said pre-cutter blades are in pairs with the blades of a said pair on opposite sides of said machine.

12. The machine according to claim 10, comprising from one to ten pre-cutter blades or pairs of pre-cutter blades.

13. The machine according to claim 11, comprising two pairs of pre-cutter blades.

14. The machine according to claim 1, wherein said plough blades have a concave face.

15. The machine according to claim 1, wherein said plough comprises a frame of at least two interconnected rails to which said blades are fixed.

16. The machine according to claim 1, wherein longitudinally-extending skids are provided on the upper edges of blades or on a frame to which said blades are fixed.

17. The machine according to claim 1, wherein said plough is adjustably carried beneath said wagon via arms of variable length fixed to at least the rear corners of said plough with upper ends of said arms fixed to wagon framework.

18. The machine according to claim 17, comprising arms of adjustable length at each corner of said plough.

19. The machine according to claim 18, wherein said adjustable arms are hydraulic rams.

20. The machine according to claim 18, wherein said arms are attached to said plough via longitudinal slides.

21. The machine according to claim 1, wherein at least one drawbar is provided that extends from the leading edge of said plough to said wagon.

22. The machine according to claim 21, wherein said at least one drawbar is attached to said plough via a shear pin.

23. The machine according to claim 1, wherein an offset ripper or scarifier tyne is included in said plough forward of the leading plough blade.

24. The machine according to claim 1, wherein at least two pairs of rail clamps are provided, wherein one pair leads the plough and the another pair trails said plough with clamps of a pair acting on opposite rails.

25. The machine according to claim 24, wherein said rail clamps are roller rail clamps.

26. The machine according to claim 1, wherein said plough comprises a plurality of blades and is covered.

27. The machine according to claim 26, wherein said covering comprises sheet material or grating spanning spaces between said blades at the upper edges thereof.

28. The machine according to claim 26, wherein said covering comprises a combination of sheet material or grating spanning spaces between said blades at the upper edges thereof.

29. The machine according to claim 26, wherein said first blade is replaced with a ramp to direct ballast over said plough.

30. The machine according to claim 1, wherein said plough has a mesh covering to allow fines and other smaller ballast particles to fall into the plough and be discharged whilst larger ballast particles pass over the plough and are returned to track.

31. The machine according to claim 1 having a vibrator associated with said plough to enhance ballast flow over the plough and separation of ballast.

32. The machine according to claim 1 comprising a plurality of ploughs.

* * * * *